US011091336B2

(12) United States Patent
Koyama

(10) Patent No.: US 11,091,336 B2
(45) Date of Patent: Aug. 17, 2021

(54) SHEET DISCHARGING APPARATUS, SHEET FEEDING APPARATUS AND IMAGE FORMING APPARATUS

(71) Applicant: CANON KABUSHIKI KAISHA, Tokyo (JP)

(72) Inventor: Tomooku Koyama, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/158,806

(22) Filed: Oct. 12, 2018

(65) Prior Publication Data

US 2019/0062088 A1 Feb. 28, 2019

Related U.S. Application Data

(63) Continuation of application No. 15/613,533, filed on Jun. 5, 2017, now Pat. No. 10,138,083.

(30) Foreign Application Priority Data

Jun. 14, 2016 (JP) ..... 2016-118175

(51) Int. Cl.
*B65H 7/04* (2006.01)
*B65H 31/04* (2006.01)
(Continued)

(52) U.S. Cl.
CPC ..... *B65H 7/04* (2013.01); *B65H 5/04* (2013.01); *B65H 5/068* (2013.01); *B65H 29/38* (2013.01);
(Continued)

(58) Field of Classification Search
None
See application file for complete search history.

(56) References Cited

U.S. PATENT DOCUMENTS 5,497,984 A 3/1996 Murakami et al.
6,170,821 B1 * 1/2001 Kubota ..... B65H 7/04 271/176
(Continued)

FOREIGN PATENT DOCUMENTS

CN 101381036 A 3/2009
CN 102897574 A 1/2013
(Continued)

OTHER PUBLICATIONS

European Search Report dated Nov. 13, 2017, in related European Patent Application No. 17172164.0.
(Continued)

*Primary Examiner* — Prasad V Gokhale
(74) *Attorney, Agent, or Firm* — Venable LLP

(57) ABSTRACT

A sheet discharging apparatus includes a first detecting portion provided in an apparatus body and configured to detect a move of a movable member in a state where a movable tray is at an upper limit position in a moving direction of the movable tray, wherein a detection result of the first detecting portion changes depending on a position of the movable tray in the moving direction. In addition, a second detecting portion detects the position of the movable tray in the moving direction, and a control portion, in a case where the second detecting portion detects that the movable tray is at the upper limit position, determines whether a sheet is present on the movable tray based on the detection result of the first detecting portion. When the second detecting portion does not detect that the movable tray is at the upper limit position, the control portion determines that a sheet is present on the movable tray regardless of the detection result of the first detecting portion.

7 Claims, 10 Drawing Sheets

(51) Int. Cl.

| | |
|---|---|
| ***B65H 31/10*** | (2006.01) |
| ***B65H 43/02*** | (2006.01) |
| ***B65H 5/04*** | (2006.01) |
| ***B65H 5/06*** | (2006.01) |
| ***B65H 29/38*** | (2006.01) |
| ***B65H 29/52*** | (2006.01) |
| *B65H 29/70* | (2006.01) |
| *B65H 31/14* | (2006.01) |
| *B65H 31/18* | (2006.01) |
| *B65H 33/08* | (2006.01) |

(52) U.S. Cl.

CPC ..... *B65H 29/52* (2013.01); *B65H 31/04* (2013.01); *B65H 31/10* (2013.01); *B65H 43/02* (2013.01); *B65H 29/70* (2013.01); *B65H 31/14* (2013.01); *B65H 31/18* (2013.01); *B65H 33/08* (2013.01); *B65H 2405/113* (2013.01); *B65H 2405/11151* (2013.01); *B65H 2511/51* (2013.01); *B65H 2553/612* (2013.01); *B65H 2553/81* (2013.01); *B65H 2801/06* (2013.01)

(56) References Cited

U.S. PATENT DOCUMENTS

| | | | |
|---|---|---|---|
| 7,971,868 | B2 | 7/2011 | Matsushima et al. |
| 8,657,283 | B2 | 2/2014 | Iwata et al. |
| 8,668,198 | B2 | 3/2014 | Tsuji et al. |
| 9,280,101 | B2 | 3/2016 | Koyama et al. |
| 9,340,391 | B2 | 5/2016 | Obuchi et al. |
| 9,400,462 | B2 | 7/2016 | Koyama et al. |
| 9,434,570 | B2 | 9/2016 | Matsuo et al. |
| 9,446,923 | B2 | 9/2016 | Yoshida et al. |
| 9,555,995 | B2 | 1/2017 | Kajiki |
| 9,944,486 | B2 | 4/2018 | Kajiki |
| 2008/0308998 | A1 | 12/2008 | Dobashi et al. |
| 2010/0225044 | A1* | 9/2010 | Tsuji ..... B42C 1/12 271/3.14 |
| 2015/0203321 | A1 | 7/2015 | Kimura et al. |
| 2017/0050817 | A1* | 2/2017 | Arai et al. ..... B65H 43/08 |
| 2017/0057773 | A1* | 3/2017 | Nakano et al. ..... B65H 31/26 |
| 2017/0121143 | A1* | 5/2017 | Kobayashi ..... G03G 15/6529 |
| 2017/0160690 | A1* | 6/2017 | Sato et al. ..... B65H 29/125 |
| 2018/0186592 | A1 | 7/2018 | Kajiki |

FOREIGN PATENT DOCUMENTS

| | | | |
|---|---|---|---|
| CN | 104176551 | A | 12/2014 |
| CN | 104276436 | A | 1/2015 |
| CN | 104936875 | A | 9/2015 |
| FR | 2780714 | A1 | 1/2000 |
| JP | 2009-102096 | A | 5/2009 |
| JP | 2009-280361 | A | 12/2009 |
| JP | 2012-041156 | A | 3/2012 |
| JP | 2012-148846 | A | 8/2012 |

OTHER PUBLICATIONS

Chinese Office Action dated Feb. 2, 2019, in related Chinese Patent Application No. 201710445232.1 (with English translation).

Chinese Office Action dated Sep. 18, 2020, in related Chinese Patent Application No. 201911248723.2 (with English translation).

* cited by examiner

SHEET DISCHARGING APPARATUS, SHEET FEEDING APPARATUS AND IMAGE FORMING APPARATUS

This application is a continuation of application Ser. No. 15/613,533, filed Jun. 5, 2017.

BACKGROUND OF THE INVENTION

Field of the Invention

The present invention relates to a sheet discharging apparatus configured to discharge a sheet, an image forming apparatus including the sheet discharging apparatus, and a sheet feeding apparatus configured to feed a sheet.

Description of the Related Art

A sheet supporting unit such as a discharge tray and a feed tray employed in an image forming apparatus, a sheet processing apparatus or the like is often provided movably with respect to a body of the image forming apparatus or the like (referred to as an 'apparatus body' hereinafter). It has been also known to provide, in the sheet supporting unit, with a detection mechanism configured to detect whether or not a sheet supported by the sheet supporting unit is present and to change an operation of the sheet supporting unit corresponding to a detection result of detecting the sheet.

Japanese Patent Laid-Open No. 2012-041156 discloses a configuration in which the detection mechanism including a paper presence detecting plate and a paper presence detecting sensor in a discharge tray of a post-processing apparatus. This detection mechanism is configured such that the paper presence detecting plate turns due to a weight of a sheet discharged to the discharge tray and the presence detecting sensor detects whether or not a sheet is present on the discharge tray by detecting a rotational displacement of the sheet presence detecting plate. Then, a control portion provided in the apparatus body controls a lift operation of the discharge tray depending on a detection result of the detection mechanism.

By the way, because the detection mechanism described in Japanese Patent Laid-Open No. 2012-041156 is disposed in the discharge tray, the detection mechanism moves up and down along the lift operation of the discharge tray. Such configuration, however, requires a length of wires such as signal lines and power lines connecting the presence detecting sensor with the apparatus body to the extent that the wires, so that the wires do not interfere with the lift operation of the discharge tray. This condition requires arrangements for guiding the wires and for preventing a user from touching and damaging the wires in accessing to the discharge tray, and may hinder cost reduction.

Meanwhile, if the detection mechanism detecting the presence of the sheet is disposed in the apparatus body, an arrangement in which the detection member abuts with an end portion of a sheet is required, and it is difficult to stably detect the sheet if the sheet is curled or the sheet is displaced.

SUMMARY OF THE INVENTION

The present disclosure provides an apparatus such as a sheet discharging apparatus and a sheet feeding apparatus, to support a sheet and configured to stably detect a presence of the sheet with a simple arrangement, and an image forming apparatus including such apparatus.

According to one aspect of the present invention, a sheet discharging apparatus includes an apparatus body, a discharge member provided in the apparatus body and configured to discharge a sheet, a movable tray movable with respect to the apparatus body and including a sheet supporting surface configured to support the sheet discharged by the discharge member, a movable member provided in the movable tray and configured to move by being pressed by the sheet supported on the sheet supporting surface, and a detecting portion provided in the apparatus body and configured to detect a presence of the sheet supported on the sheet supporting surface in response to a position of the movable member.

According to another aspect of the present invention, a sheet feeding apparatus includes an apparatus body, a feed member provided in the apparatus body and configured to feed a sheet, a movable tray movable with respect to the apparatus body and including a sheet supporting surface configured to support the sheet to be fed by the feed member, a movable member provided in the movable tray and configured to move by being pressed by the sheet supported on the sheet supporting surface, and a detecting portion provided in the apparatus body and configured to detect a presence of the sheet supported on the sheet supporting surface in response to a position of the movable member.

Further features of the present invention will become apparent from the following description of exemplary embodiments with reference to the attached drawings.

DESCRIPTION OF THE EMBODIMENTS

A sheet supporting unit and an image forming apparatus of the present disclosure will be described below with reference to the drawings. It is noted that the image forming apparatus encompasses apparatuses such as a printer, a copier and a scanner as well as a multi-function printer having functions of those apparatuses. It is also noted that the sheet supporting unit encompasses such an apparatus configured to support a sheet discharged out of an apparatus body of an image forming apparatus (sheet discharge apparatus), an apparatus configured to support a sheet to be supplied to the apparatus body (sheet feeding apparatus), and an apparatus configured to temporarily support a sheet to be passed from one apparatus to another apparatus.

First Embodiment

Figure 1:
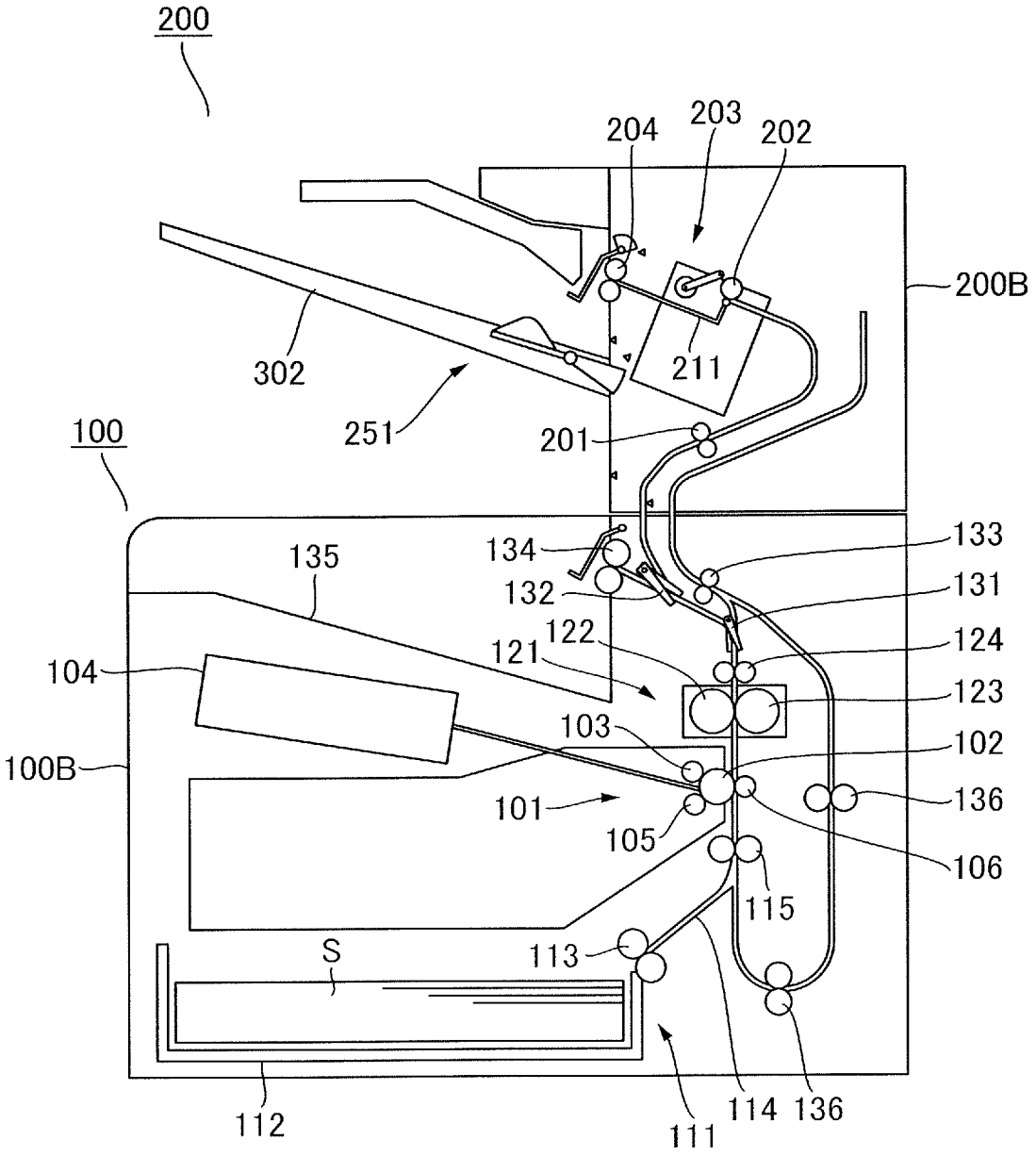
FIG. 1 is a schematic diagram illustrating a configuration of an image forming apparatus.

A configuration of an image forming apparatus 100 according to a first embodiment will be described with reference to FIG. 1. The image forming apparatus 100 is a monochrome digital printer configured to form an image onto a sheet S based on image information inputted from an external device such as a personal computer. The sheet S refers to a thin recording material such as a sheet of paper and an envelope, a plastic film such as an overhead projector sheet (overhead transparency), and a cloth. Attached above a printer body 100B which is a body the image forming apparatus 100 is a sheet processing apparatus 200 configured to process the sheet S outputted from the printer body 100B.

The image forming apparatus 100 is configured to form an image onto the sheet S by an electrophotographic image forming unit 101 including a photosensitive drum 102. The image forming unit 101 is one example of an image forming portion configured to form an image onto the sheet S. The photosensitive drum 102 is a cylindrical photoconductor and rotatable in a direction along a conveyance direction, i.e., upward in FIG. 1, of the sheet S. Disposed around the photosensitive drum 102 in a rotation direction of the photosensitive drum 102 are an electrifying roller 103, a developing unit 105, and a transfer roller 106.

A toner image is formed through a following image forming process in the image forming unit 101. At first, a surface of the photosensitive drum 102 is electrified uniformly by the electrifying roller 103. The electrified photosensitive drum 102 is exposed with a scan light projected from the exposure unit 104 and an electrostatic latent image is formed on the photosensitive drum 102 corresponding to the image information. The developing unit 105 supplies electrified toner to the photosensitive drum 102 to develop the electrostatic latent image into a toner image. The toner image borne on the surface of the photosensitive drum 102 is transferred onto the sheet S by a bias voltage applied to the transfer roller 106.

The printer body 100B includes a sheet feed portion 111 configured to feed the sheet S and a fixing portion 121 configured to fix the toner image onto the sheet S. The sheet feed portion 111 includes a sheet feed cassette 112 as a storage portion for storing the sheet S and a feed roller 113 serving as a feed member that feeds the sheet S stored in the sheet feed cassette 112 one by one to the image forming unit 101. The sheet S fed from the sheet feed portion 111 is sent to a registration roller pair 115 to correct a skew thereof and is then sent to a transfer nip portion between the photosensitive drum 102 and a transfer roller 106 to form the toner image on the sheet.

The sheet S which has passed through the transfer nip portion and on which the non-fixed image has been formed is pressed and heated while being nipped between a fixing roller 122 and a pressure roller 123 of the fixing portion 121, so that toner of the image melts and is fixed to the sheet S. In a case when a duplex printing is made on the sheet S onto which the image has been fixed, the sheet S is conveyed to a reversing roller pair 133 by passing through a route selected by a duplex switching member 131. Then, after being switched back by the reversing roller pair 133, the sheet S is conveyed again to the image forming unit 101 through a duplex conveyance roller pair 136 to form an image on a back surface thereof.

In a case when no post-processing is made on the sheet S on which the output of the image on one side or both sides has been completed, the sheet S is sent to a discharge roller pair 134 through a route selected by a duplex switching member 131 and is discharged onto a discharge portion 135 formed at an upper part of the printer body 100B. When a post-processing is made on the sheet S, the sheet S is sent to a sheet processing apparatus 200.

A processing apparatus body 200B of the sheet processing apparatus 200 includes an inlet roller pair 201, a processing portion 203 and a discharge roller pair 204. The sheet processing apparatus 200 also includes a discharge tray 302 movably supported by the processing apparatus body 200B. The inlet roller pair 201 receives the sheet S discharged out of the printer body 100B and conveys the sheet S toward the processing portion 203. The processing portion 203 includes a processing stage 211 configured to support the sheet S and a processing stage roller 202 configured to release the sheet S to the processing stage 211 and performs processing such as stapling and punching to the sheet S supported on the processing stage 211. The processed sheet S is discharged by the discharge roller pair 204 onto the discharge tray 302.

Sheet Discharge Portion

Figure 2:
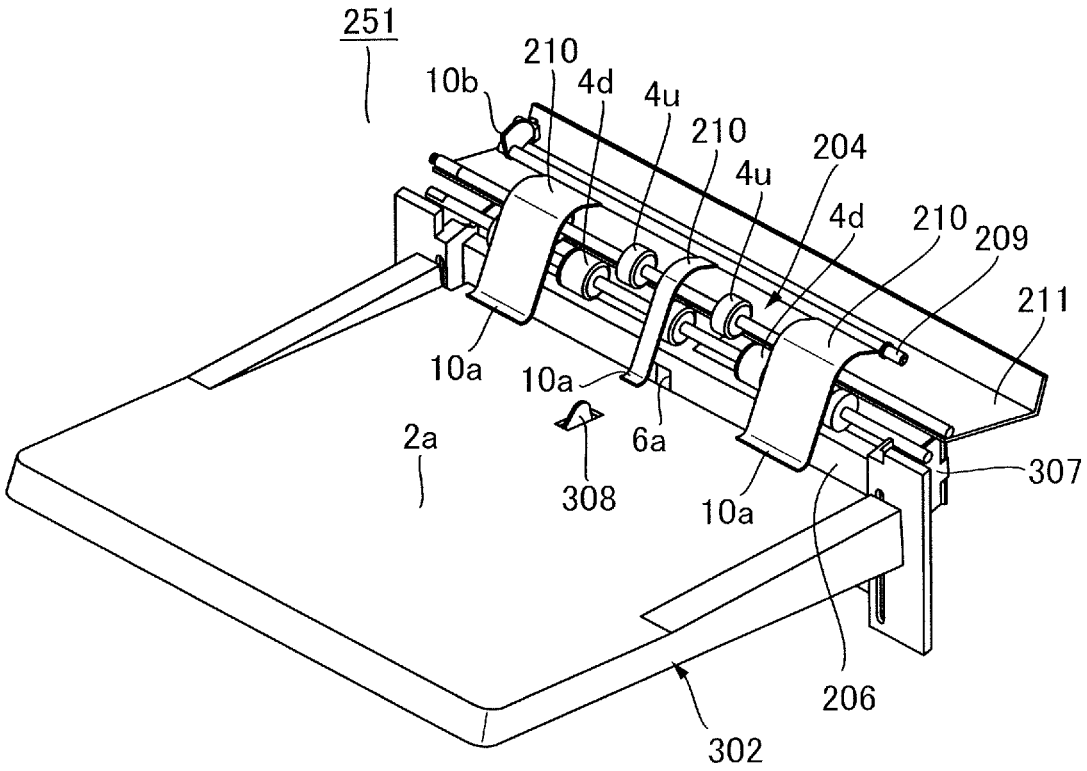
FIG. 2 is a perspective view of a discharge tray of a first embodiment.
Figure 3:
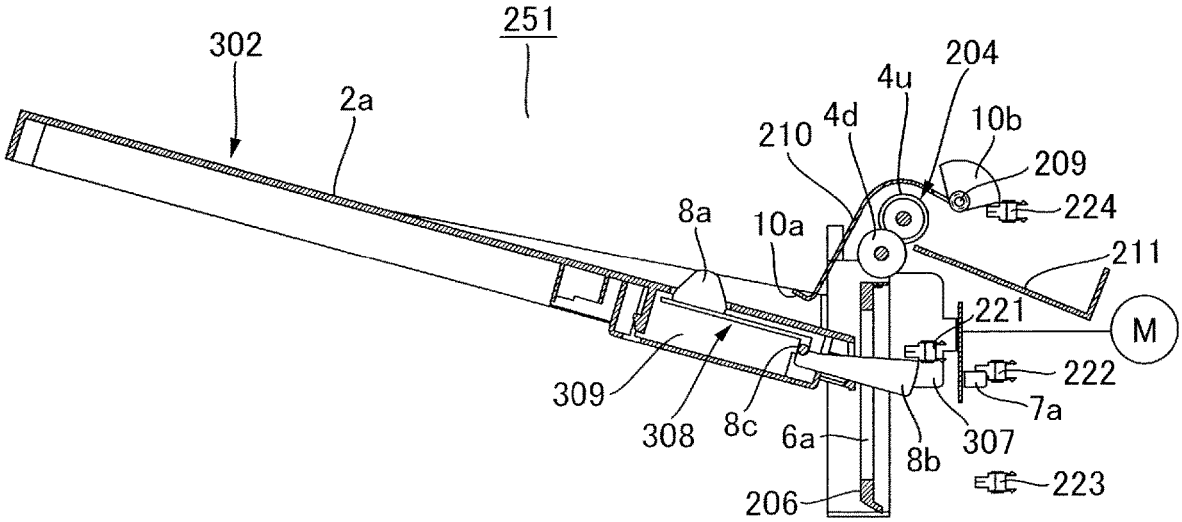
FIG. 3 is a section view of the discharge tray of the first embodiment.

Next, a configuration of a sheet discharge portion 251 which is one example of the sheet supporting unit will be described. As illustrated in FIGS. 2 and 3, the sheet discharge portion 251 includes the discharge tray 302 and a side wall portion 206 of the processing apparatus body 200B. The processing apparatus body 200B is one example of an apparatus body supporting a movable tray. It is noted that while the body part of the sheet processing apparatus 200 corresponds to the apparatus body, the body part of the image forming apparatus corresponds to the apparatus body in a case when the movable tray is supported by the body part, e.g., the printer body 100B, of the image forming apparatus.

The discharge tray 302, which is one example of a movable tray, is supported by the processing apparatus body 200B through a tray stay 307. The tray stay 307 is connected with a lifting motor M, which serves as a driving source, in the processing apparatus body 200B through a drive train and moves up and down in a vertical direction, i.e., a direction that is regarded as substantially vertical with respect to a floor surface on which the image forming apparatus is located, along a slit 6*a* serving as an opening portion defined through the side wall portion 206. A supporting surface 2*a* of the discharge tray 302, i.e., a sheet supporting surface, is inclined such that the surface rises higher as the surface extends from the side wall portion 206. Accordingly, the side wall portion 206 functions as an alignment reference wall, i.e., a support reference wall, that abuts with an end portion of the sheet S supported on the supporting surface 2*a* of the discharge tray 302 and aligns the sheet S.

The discharge roller pair 204, which serves as a discharge member for discharging the sheet S to the movable tray, is composed of upper and lower rollers 4*u* and 4*d* and discharges the sheet S on the processing stage 211 to the discharge tray 302. The upper and lower rollers 4*u* and 4*d* are disposed alternately in a shaft direction as illustrated in FIG. 2 and release the sheet S with a discharge angle inclined upward along an inclination angle of the supporting surface 2*a* of the discharge tray 302 as illustrated in FIG. 3.

Now, a detection mechanism for detecting a presence and the amount of the sheet S supported on the discharge tray 302 will be described. The detection mechanism includes a sheet presence detecting flag 308, a detecting flag holder 309, a sheet presence detecting sensor 221, a sheet surface detecting flag 210, a sheet surface detection sensor 224, an upper limit position sensor 222 and a lower limit position sensor 223 as illustrated in FIG. 3.

The sheet presence detecting flag 308, which is one example of a movable member, is held swingably by the detecting flag holder 309 fixed to the discharge tray 302. The sheet presence detecting flag 308 includes a sheet abutment portion 8*a* and an extension portion 8*b* extending toward the side wall portion 206 and swings vertically centering on a swing shaft 8*c* when the sheet S presses the sheet abutment portion 8*a*. As illustrated in FIG. 3, the extension portion 8*b* extends to an inside of the side wall portion 206 through the slit 6*a* defined within the side wall portion 206 along a vertical direction. The discharge tray 302 is also provided with an opening portion defined at a position corresponding to the sheet abutment portion 8*a* as illustrated in FIG. 2.

The sheet presence detecting flag 308 is movable between a first position, i.e., a standby position (position illustrated in FIG. 2), where the sheet abutment portion 8*a* projects above the supporting surface 2*a* of the discharge tray 302 and a second position, i.e., a detection position, where a level of the sheet abutment portion 8*a* is lower than the supporting surface 2*a*. A weight ratio of the sheet abutment portion 8*a* and the extension portion 8*b* is set such that the sheet presence detecting flag 308 is located at the standby position by its own weight when the sheet abutment portion 8*a* is not pressed by the sheet S.

The sheet presence detecting sensor 221, which serves as a detecting portion configured to detect the position of the movable member, is a transmission type optical sensor (photo-interrupter). The sheet presence detecting sensor 221 is attached to the processing apparatus body 200B and is configured to detect the extension portion 8*b* and turn ON (detection state) when the sheet presence detecting flag 308 is located at the detection position. The sheet presence detecting sensor 221 is disposed in the processing apparatus body 200B, i.e., the inside of the apparatus, with respect to the side wall portion 206 in a view from FIG. 2.

As illustrated in FIGS. 2 and 3, the sheet surface detecting flag 210 includes an abutment portion 10*a* abuttable with the sheet S supported on the discharge tray 302 and swings vertically centering on a support shaft 209 supported by the processing apparatus body 200B. The sheet surface detecting flags 210 are disposed at center and both end portions, i.e., three places in total, in the axial direction of the support shaft 209 as illustrated in FIG. 2 and all swing together with the support shaft 209. The abutment portion 10*a* extends downward from the support shaft 209 by turning above the discharge roller pair 204 and faces the supporting surface 2*a* of the discharge tray 302 as illustrated in FIG. 3.

The sheet surface detection sensor 224 serving as a sheet amount detecting portion is a photo interrupter capable of detecting a sensor shading portion 10*b* of the sheet surface detecting flag 210. The sensor shading portion 10*b* is disposed at one end of the support shaft 209 (see FIG. 2). The sheet surface detection sensor 224 is configured to be shaded by the sensor shading portion 10*b* and turns ON when the abutment portion 10*a* of the sheet surface detecting flag 210 is lifted more than a predetermined distance by the sheet S supported on the discharge tray 302.

Disposed within the processing apparatus body 200B are an upper limit position sensor 222, which serves as an upper limit position detecting portion, configured to detect that the discharge tray 302 is located at a predetermined position, i.e., an upper limit position of a vertically movable range, and a lower limit position detecting portion configured to detect that the discharge tray 302 is located at a lower limit position of the movable range. Both of the upper and lower limit position sensors 222 and 223 are photo interrupters shaded by a sensor shading portion 7*a* provided on the tray stay 307. The movable range of the discharge tray 302 is defined by a vertical interval between the upper and lower limit position sensors 222 and 223.

Figure 5A:
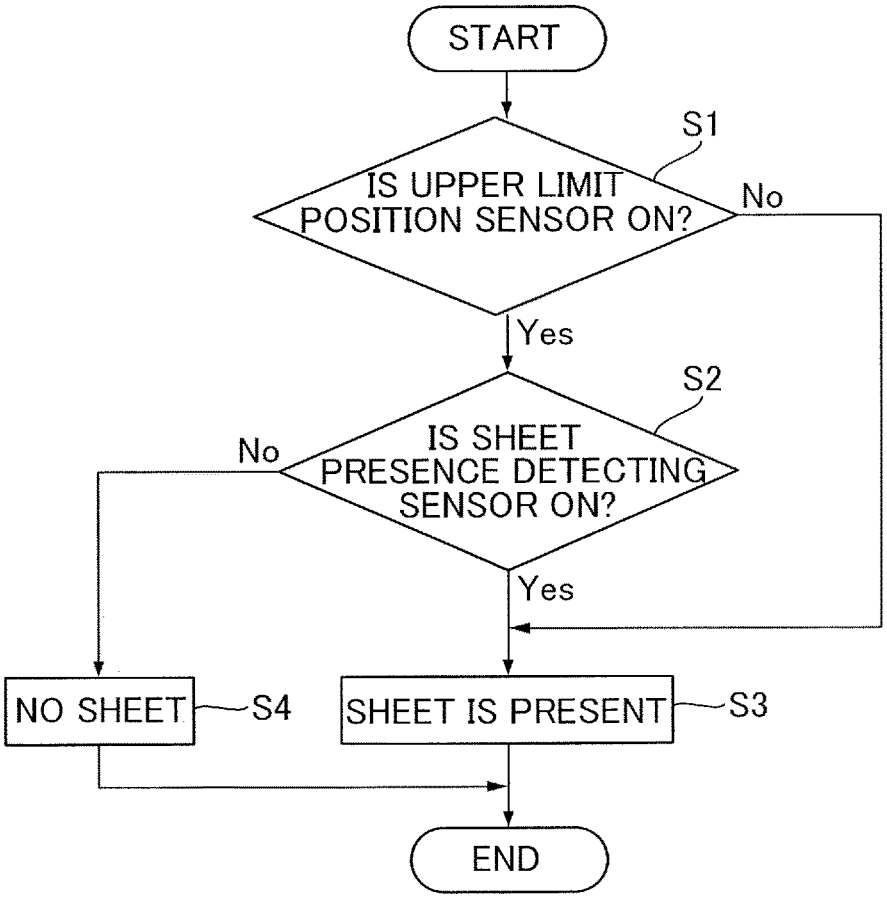
FIG. 5A is a flowchart illustrating a process for determining a presence of a sheet supported on the discharge tray in the first embodiment.
Figure 5B:
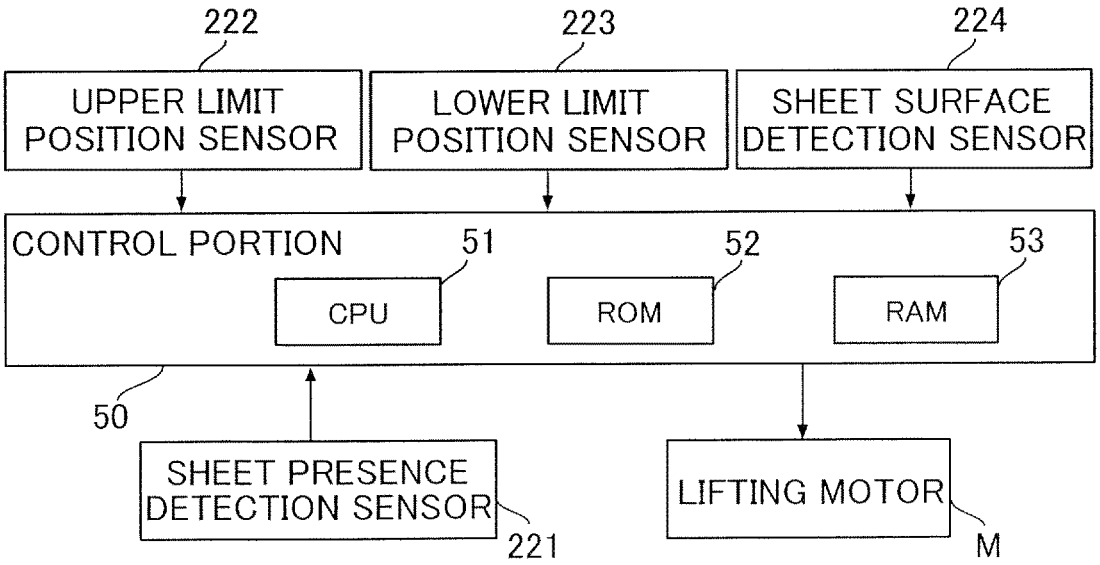
FIG. 5B is a block diagram illustrating a configuration for controlling for the discharge tray.

The sheet presence detecting sensor 221, and the upper and lower limit position sensors 222 and 223 are connected respectively with a control portion 50 disposed in the processing apparatus body 200B or the printer body 100B (see FIG. 5B). As described in detail later, the control portion 50 controls the lifting motor M so as to lift the discharge tray in response to detection results of these sensors 221, 222 and 223. Wires electrically connecting a group of these sensors with the control portion 50, i.e., signal lines and/or power lines, are wired through routes within the side wall portion 206 and not overlapping with movement trajectory of the discharge tray 302, the tray stay 307 and others when the discharge tray 302 makes a lift operation.

Lift Operation of Discharge Tray

Figure 4A:
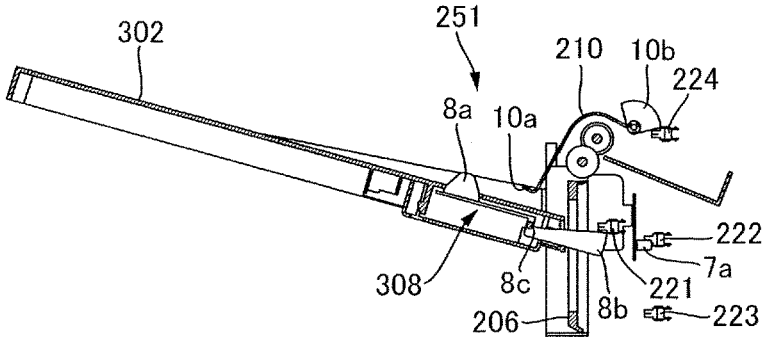
FIG. 4A is a section view illustrating a first stage of an operation of the discharge tray of the first embodiment.

Next, the lift operation of the discharge tray 302 will be described with reference to FIGS. 4A through 4E. In a case when no sheet S is supported on the discharge tray 302 as illustrated in FIG. 4A, the discharge tray 302 is held at the predetermined position, i.e., the upper limit position, where the upper limit position sensor 222 is shaded by the sensor shading portion 7*a* and turns ON. At this time, the sheet presence detecting flag 308 is located at the standby position and the sheet presence detecting sensor 221 is turned OFF. The sheet surface detection sensor 224 is also located at a home position where the abutment portion 10*a* hangs down by its own weight and the sheet surface detection sensor 224 is OFF.

Figure 4B:
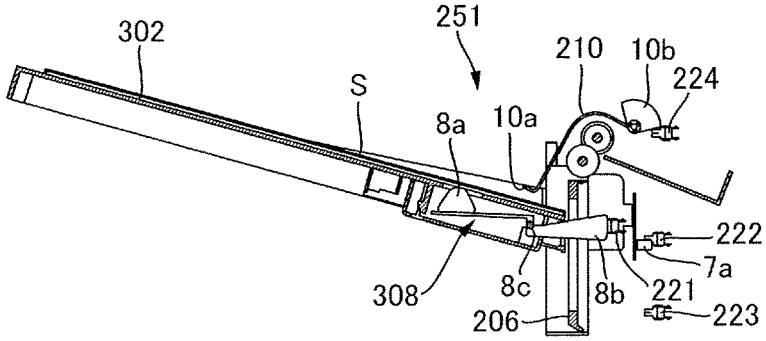
FIG. 4B is a section view illustrating a second stage of the operation of the discharge tray of the first embodiment.

When a sheet S, or a bundle of sheets, is discharged onto the discharge tray 302 as illustrated in FIG. 4B, the sheet presence detecting flag 308 swings from the standby position to the detection position by the weight of the sheet S. When the sheet presence detecting sensor 221 is shaded by the extension portion 8*b* of the sheet presence detecting flag 308 and is turned ON, the control portion judges that the sheet S is present on the discharge tray 302 (see a control flow in FIG. 5A described later). It is noted that a weight balance of the sheet presence detecting flag 308 is set such that the sheet presence detecting flag 308 moves to the detection position by the weight of a sheet S of a smallest size that can be outputted by the image forming apparatus 100.

Figure 4C:
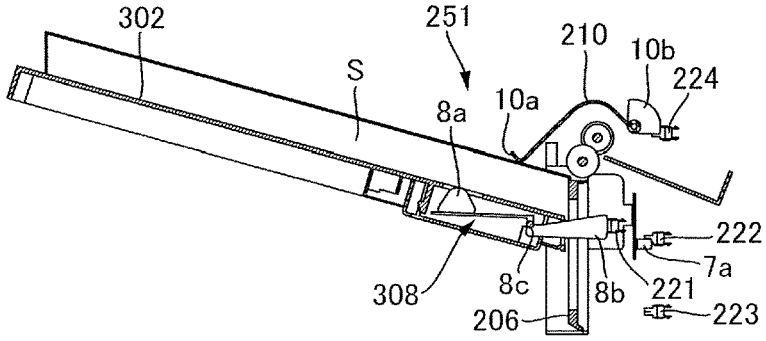
FIG. 4C is a section view illustrating a third stage of the operation of the discharge tray of the first embodiment.

When more sheets S are discharged onto the discharge tray 302 as illustrated in FIG. 4C, the abutment portion 10*a* of the sheet surface detecting flag 210 is lifted up depending on a height of an uppermost sheet. At this time, the sheet surface detecting flag 210 moves from the home position, and the sheet surface detection sensor 224 turns ON by being shaded by the sensor shading portion 10*b*. Detecting that the sheet surface detection sensor 224 is turned ON, the control portion sends a signal to the lifting motor M to lower the discharge tray 302 by a predetermined amount. Here, the predetermined amount is a distance set in advance such that the sheet surface detection sensor 224 is turned OFF at least by the move of the sheet surface detecting flag 210.

Figure 4D:
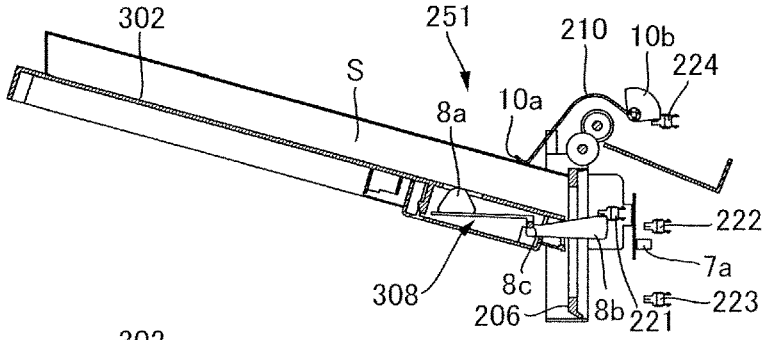
FIG. 4D is a section view illustrating a fourth stage of the operation of the discharge tray of the first embodiment.

When the discharge tray 302 drops by the predetermined amount as illustrated in FIG. 4D, the sheet surface detection sensor 224 is turned OFF. Still further, the sensor shading portion 7*a* of the tray stay 307 deviates from a detection range of the upper limit position sensor 222 and the upper limit position sensor 222 is turned OFF.

Then the control portion lowers the discharge tray 302 by the predetermined amount every time when the sheet surface detection sensor 224 is turned ON during when the sheets S is discharged sequentially by the discharge roller pair 204. When the discharge tray 302 drops to a position where the sensor shading portion 7*a* of the sheet tray 7 shades the lower limit position sensor 223 and the lower limit position sensor 223 is turned ON, i.e., to the lower limit position, the control portion stops to lower the discharge tray 302.

Figure 4E:
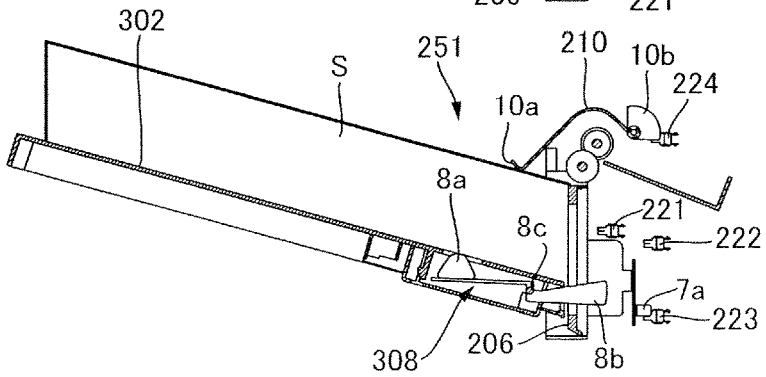
FIG. 4E is a section view illustrating a fifth stage of the operation of the discharge tray of the first embodiment.

When the sheet S is discharged more and the sheet surface detection sensor 224 is turned ON in the state in which the discharge tray 302 is located at the lower limit position as illustrated in FIG. 4E, the control portion judges that the discharge tray 302 is fully loaded. In this case, the control portion stops the image forming process of the printer body 100B and informs a user that the discharge tray 302 is fully loaded by displaying a message, for example, on a liquid crystal display not illustrated.

If the user removes the sheet S on the discharge tray 302 and the sheet surface detection sensor 224 is turned OFF, the control portion elevates the discharge tray 302 by driving the lifting motor M. It is noted that the discharge tray 302 stops to elevate at a timing when the upper limit position sensor 222 or the sheet surface detection sensor 224 is turned ON. That is, the discharge tray 302 elevates to the upper limit position in a case when no sheet or a small number of sheets S is supported on the discharge tray 302, and stops at a position where the sheet surface detection sensor 224 is turned ON in a case other than that.

Detection of Presence of Sheet

In the operation of the sheet discharge portion 251 described above, whether or not the sheet S is present and supported on the supporting surface 2*a* of the discharge tray 302 is judged based on the detection signals transmitted from the sheet presence detecting sensor 221 and the upper limit position sensor 222. That is, as illustrated in a flowchart in FIG. 5A, the control portion determines whether a sheet is present on the discharge tray 302 such that when the upper limit position sensor 222 is OFF (No in Step S1), or when the sheet presence detecting sensor 221 is OFF (Yes in Step S2), it is determined that the sheet is present in Step S3. The reason for this is that it is presumed that the sheet S is supported on the discharge tray 302 regardless of the detection result of the sheet presence detecting sensor 221 when the upper limit position sensor 222 is OFF. Meanwhile, the control portion judges that there is no sheet on the discharge tray 302 in Step S4 when the upper limit position sensor 222 is ON (Yes in Step S1), and the sheet presence detecting sensor 221 is OFF (No in Step S2).

As illustrated in FIG. 5B, the control portion 50 includes a central processing unit (CPU) 51, a read only memory (ROM) 52 and a random-access memory (RAM) 53 storing programs to be executed by the CPU 51. The control portion 50 detects the presence of the sheet on the discharge tray 302 and controls the drive of the lifting motor M based on the detection signals transmitted from the sheet presence detecting sensor 221, the upper limit position sensor 222, the lower limit position sensor 223, and the sheet surface detection sensor 224.

According to the present embodiment, the sheet presence detecting flag 308 is disposed on the discharge tray 302 and the sheet presence detecting sensor 221 is disposed in the processing apparatus body 200B. This arrangement makes it possible to eliminate wires otherwise necessary to connect the discharge tray 302 with the processing apparatus body 200B in the configuration of detecting the presence of the sheet S supported on the discharge tray 302 by the arrangement described above. That is, it is possible to reduce the cost and to improve a degree of freedom of design because guide configurations for guiding such wires and configurations for preventing the user from touching the wires are not necessary in the present embodiment.

Here, it is conceivable to dispose the sheet presence detecting flag in the processing apparatus body 200B as an alternative configuration. That is, it is conceivable to eliminate the wires connecting the discharge tray 302 with the processing apparatus body 200B by attaching the sheet presence detecting flag directly on the processing apparatus body 200B, e.g., on the side wall portion 206. In this case, in order to avoid the sheet presence detecting flag from being damaged along with the elevation of the discharge tray 302, it is natural to adopt a configuration in which the sheet presence detecting flag abuts with the end of the sheet S supported on the discharge tray 302, differing from the present embodiment. However, it is unable to obtain enough detection accuracy by such arrangement because an abutment condition between the flag and the sheet becomes unstable when the sheet S supported on the discharge tray 302 is curled or is displaced by being moved by the user.

Meanwhile, the sheet presence detecting flag 308 of the present embodiment projects above the supporting surface 2*a* of the discharge tray 302 approximately at a center position in a sheet width direction orthogonal to a discharge direction of the discharge roller pair 204 (see FIG. 2). This arrangement makes it possible to detect the sheet S stably because the abutment condition between the flag and the sheet is hardly disturbed by curl or displacement of the sheet S.

The sheet abutment portion 8*a* of the sheet presence detecting flag 308 is specifically disposed downstream in the discharge direction of the abutment portion 10*a* of the sheet surface detecting flag 210 (see FIG. 3). Therefore, the sheet abutment portion 8*a* detects the sheet S in a condition pressed by the weight of the sheet surface detecting flag 210 and can stably detect the sheet S even if an upstream end in the discharge direction of the sheet S is curled or the sheet S is separated from the side wall portion 206.

Still further, according to the present embodiment, the control portion judges whether or not the sheet S is present through the detection result of the upper limit position sensor 222, with the configuration in which the sheet presence detecting flag 308 is disposed on the discharge tray 302 and the sheet presence detecting sensor 221 is disposed in the processing apparatus body 200B. This arrangement makes it possible to accurately detect whether or not the sheet S is present on the discharge tray 302 and to move the discharge tray 302 up and down corresponding to the amount of the sheets S without moving the sheet presence detecting sensor 221 up and down following the discharge tray 302. However, this does not mean that the sheet presence detecting sensor 221 has to be used together with the upper limit position sensor 222.

It is noted that while the sheet presence detecting flag 308 is configured to be located at the standby position by its own weight, an urging member such as a spring may be disposed for example. In this case, it is possible to obtain the same advantageous effects with the present embodiment by configuring such that the sheet presence detecting flag 308 is located at the standby position when the sheet S is not in contact with the sheet presence detecting flag 308 and moves to the detection position when the sheet presence detecting flag 308 is pressed by the sheet S.

Second Embodiment

Next, a configuration of a sheet discharge portion 252 according to a second embodiment will be described with reference to FIGS. 6 through 8B. The sheet discharge portion 252 is different from the sheet discharge portion 251 of the first embodiment described above in that a flag link 212 interlocked with a sheet presence detecting flag is provided, and other components are substantially the same with those of the first embodiment. Therefore, elements common with those in the first embodiment will be denoted by the same reference numerals and their explanation will be omitted.

Figure 6:
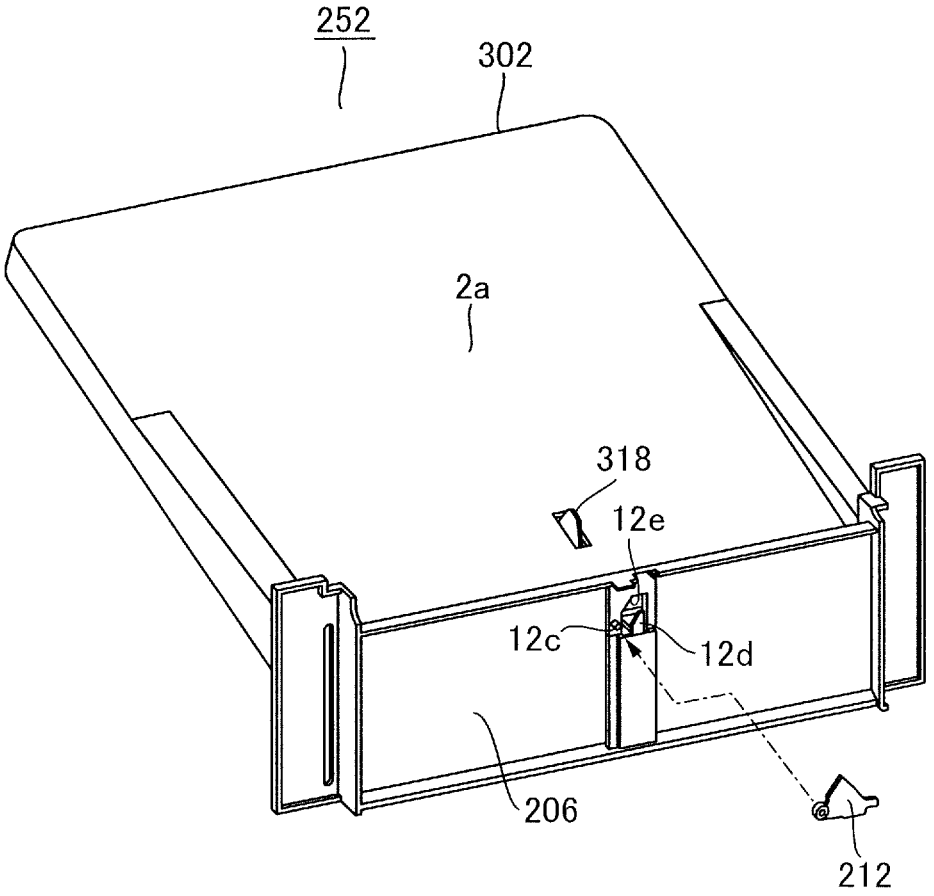
FIG. 6 is a perspective view schematically illustrating a configuration for attaching a flag link of a second embodiment.
Figure 7A:
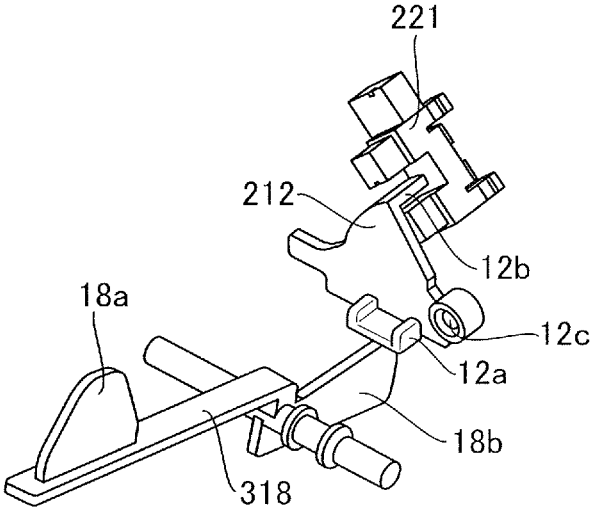
FIG. 7A is a perspective view illustrating a sheet presence detection mechanism of the second embodiment in a case when there is no sheet on the discharge tray.

As illustrated in FIGS. 6 and 7A, a sheet presence detecting flag 318, which is another example of the movable member, is supported swingably by the discharge tray 302. Similarly to the first embodiment, the sheet presence detecting flag 318 includes a sheet abutment portion 18*a* abuttable with the sheet S supported on the discharge tray 302 and an extension portion 18*b* extending toward the side wall portion 206 and swings vertically centering on a swing shaft 18*c*. However, no slit like that of the first embodiment is defined within the side wall portion 206, and an end portion of the extension portion 18*b* is located outside of the side wall portion 206.

A flag link 212, which is one example of a turning member, is attached to a turning shaft 12*c* formed on the side wall portion 206 and supported turnably by the processing apparatus body 200B. The flag link 212 includes an abutment portion 12*a* abuttable with the extension portion 18*b* of the sheet presence detecting flag 318 and a projecting portion 12*b* projecting into the processing apparatus body 200B through the opening portion 12*e* defined through the side wall portion 206. That is, the flag link 212 turns when the abutment portion 12*a* is pressed by the extension portion 18*b* of the sheet presence detecting flag 318. Still further, the flag link 212 has a weight enabling to hold the sheet presence detecting flag 318 at the standby position when no sheet S is in contact with the sheet presence detecting flag 318. It is noted that a holding portion 12*d* configured to hold the flag link 212 attached to the turning shaft 12*c* is integrally formed with the side wall portion 206.

Figure 7B:
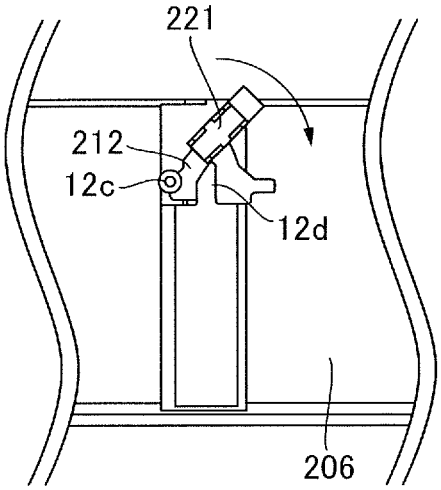
FIG. 7B is a schematic diagram illustrating a position of the flag link.
Figure 8A:
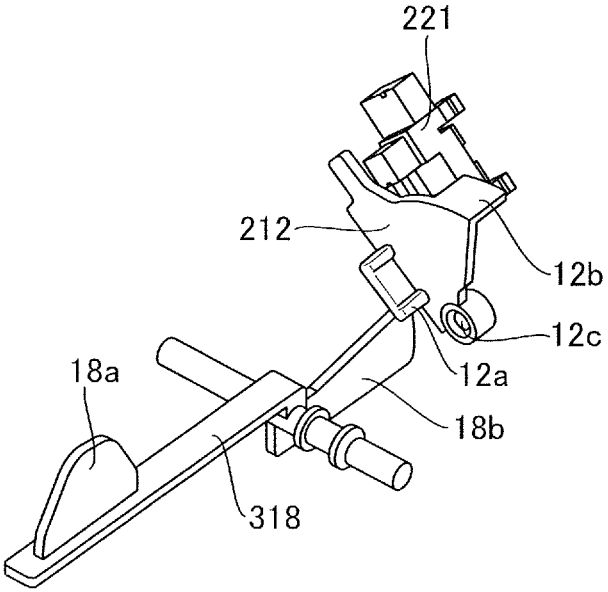
FIG. 8A is a perspective view illustrating the sheet presence detection mechanism of the second embodiment in a case when there is a sheet on the discharge tray.
Figure 8B:
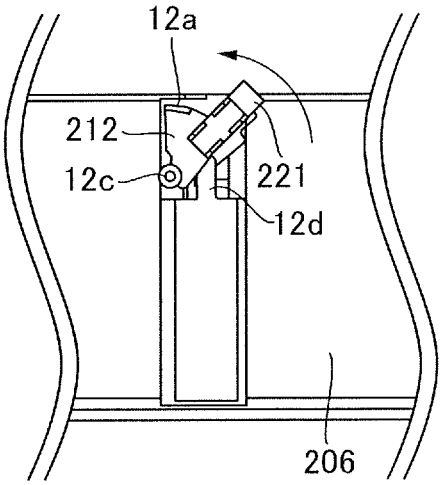
FIG. 8B is a schematic diagram illustrating a position of the flag link.

The sheet presence detecting sensor 221, which is one example of the detecting portion, is disposed at a position supported by the processing apparatus body 200B and capable of detecting the projecting portion 12*b* of the flag link 212. As illustrated in FIGS. 7A and 7B, the sheet presence detecting sensor 221 is shaded by the projecting portion 12*b* and the sheet presence detecting sensor 221 is turned ON when the sheet presence detecting flag 318 is located at the standby position. Still further, as illustrated in FIGS. 8A and 8B, when the sheet presence detecting flag 318 is located at the detection position, the flag link 212 turns upward, the shade of the sheet presence detecting sensor 221 is released, and the sheet presence detecting sensor 221 is turned OFF.

It is noted that while FIGS. 7A through 8B illustrate cases when the discharge tray 302 is located at the upper limit position, the sheet presence detecting flag 318 separates from the flag link 212 in a condition in which the discharge tray 302 drops more than a certain amount. In such cases, the flag link 212 is located at a position turned downward by its own weight (see FIG. 7B) and the sheet presence detecting sensor 221 is turned ON.

The control portion judges whether or not the sheet S is present on the discharge tray 302 through a process indicated by a flowchart similar to that of the first embodiment. That is, if the upper limit position sensor 222 is OFF or if the sheet presence detecting sensor 221 is OFF, the control portion judges that the sheet is present on the discharge tray 302. In contrast, if the upper limit position sensor 222 is ON and if the sheet presence detecting sensor 221 is ON, the control portion judges that no sheet is present on the discharge tray 302.

The configurations in the present embodiment as described above also realize that the sheet presence detecting sensor 221 located inside of the side wall portion 206 detects swing positions of the sheet presence detecting flag 318. Then, it is possible to obtain similar advantages to those in the first embodiment. That is, it is possible to reduce the production cost and to improve a degree of freedom of design because guide configurations for guiding wires for connecting the processing apparatus body 200B with the discharge tray 302 and configurations for preventing the user from touching the wires are not necessary.

In addition, the entire sheet presence detecting flag 318 is disposed outside of the side wall portion 206 by providing the flag link 212 supported by the processing apparatus body 200B. Due to that, it is unnecessary to define a cutout such as the slit through the side wall portion 206 for avoiding the moving trajectory of the sheet presence detecting flag 318 as compared to the first embodiment. In other words, it is possible to minimize the opening portion 12*e* (see FIG. 6) defined within the side wall portion 206 in the configuration in which the sheet presence detecting sensor 221 located inside of the processing apparatus body 200B detects the position of the sheet presence detecting flag 318 located outside of the processing apparatus body 200B. This configuration enables preventing the user from accessing to the inside of the side wall portion 206 and improving strength of the side wall portion 206.

It is noted that the flag link 212 released from the sheet presence detecting flag 318 is positioned by its own weight in the present embodiment, an urging member such as a spring may be disposed as long as the flag link 212 is configured to be turned by being pressed by the sheet presence detecting flag 318.

Third Embodiment

Next, a sheet discharge portion 253 according to a third embodiment will be described with reference to FIGS. 9A through 9C. The sheet discharge portion 253 of the present embodiment is different from that of the second embodiment in that a weight ratio among the members is specifically set, and other components are substantially the same with those of the second embodiment. Therefore, elements common with those in the first and second embodiments will be denoted by the same reference numerals and their explanation will be omitted here.

A sheet presence detecting flag 328, which is still another example of the movable member includes a sheet abutment portion 28*a* abuttable with the sheet S supported on the discharge tray 302 and an extension portion 28*b* extending toward the processing apparatus body 200B and swings centering on a swing shaft 28*c*. Still further, a flag link 232 which is one example of the turning member includes an abutment portion 32*a* abuttable with the extension portion 28*b* and a projecting portion 32*b* capable of shading the sheet presence detecting sensor not illustrated and turns by being pressed by the sheet presence detecting flag 328.

Figure 9A:
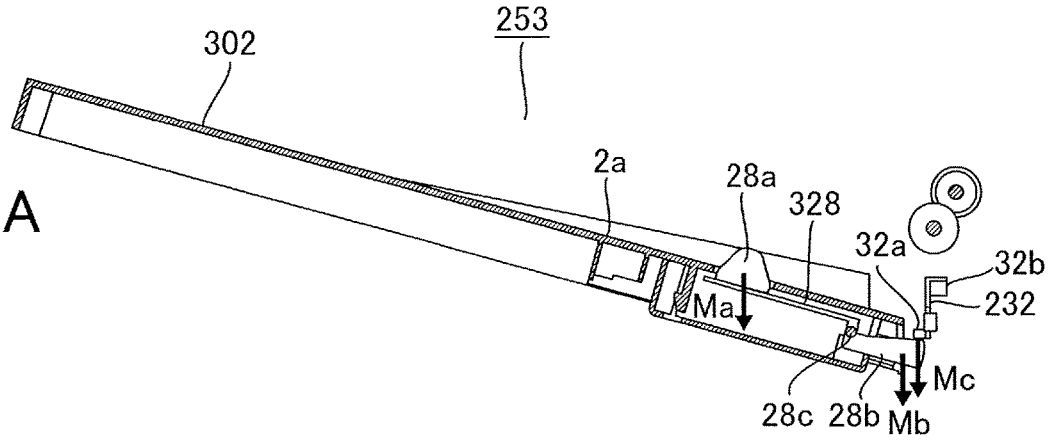
FIG. 9A is a section view illustrating an operation of a discharge tray of a third embodiment in a state in which no sheet is supported on the discharge tray.
Figure 9B:
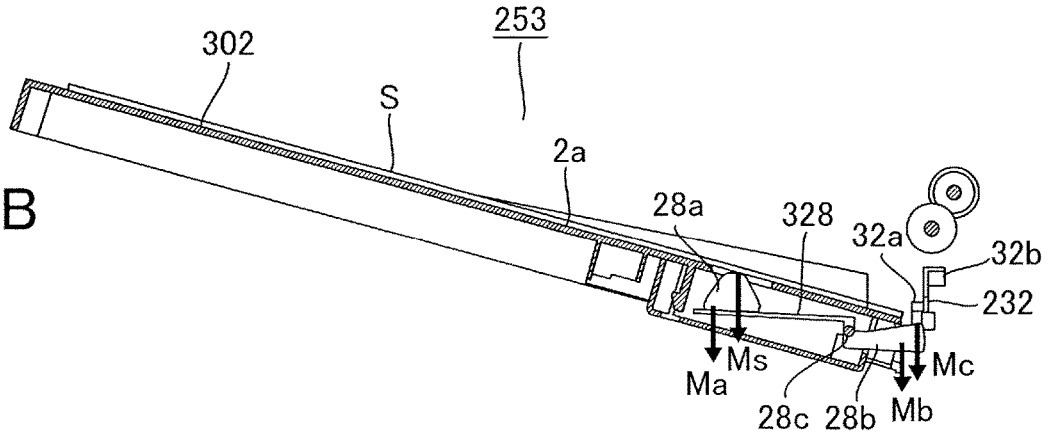
FIG. 9B illustrates a state in which one sheet is supported on the discharge tray.
Figure 9C:
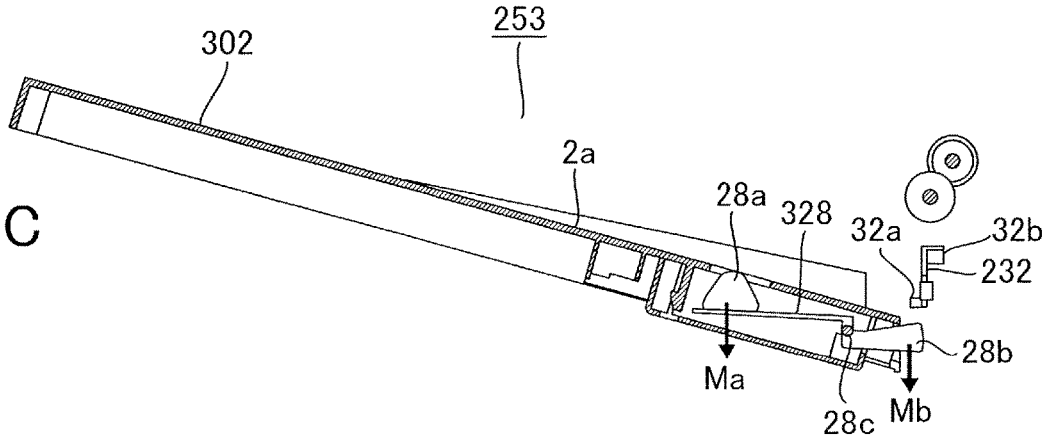
FIG. 9C illustrates a state in which the sheet which has been supported on the discharge tray is removed.

A weight ratio of the sheet presence detecting flag 328 and the flag link 232 is set such that the sheet presence detecting flag 328 and the flag link 232 take following behaviors in each step illustrated in FIGS. 9A through 9C.

As illustrated in FIG. 9A, in a case when the discharge tray 302 is located at the upper limit position and no sheet S is supported on the discharge tray 302, the sheet presence detecting flag 328 comes into contact with the flag link 232 and the sheet presence detecting flag 328 is located at the standby position. That is, the sheet abutment portion 28*a* projects above the supporting surface 2*a* of the discharge tray 302 by weights of the extension portion 28*b* and the flag link 232. In this case, the sheet presence detecting sensor 221 is turned ON.

As illustrated in FIG. 9B, if one sheet S is supported on the discharge tray 302 in the state in which the discharge tray 302 is located at the upper limit position, the sheet presence detecting flag 328 moves from the standby position to the detection position by a weight of the sheet S. At this time, the flag link 232 is pushed up by the extension portion 28*b* of the sheet presence detecting flag 328, and the sheet presence detecting sensor 221 is turned OFF.

FIG. 9C illustrates a state in which the sheet S which has been supported on the discharge tray 302 is removed when the discharge tray 302 is located at a position under the upper limit position and where the sheet presence detecting flag 328 separates from the flag link 232. In this case, the sheet presence detecting flag 328 stays at the detection position by its own weight and the sheet abutment portion 28*a* keeps a position receded to a level under the supporting surface 2*a*.

A configuration realizing such operation can be represented as a relationship of moments acting on the sheet presence detecting flag 328 centering on the swing shaft 28*c*, as follows. As illustrated in FIGS. 9A and 9B, a moment acting counterclockwise, i.e., counterclockwise in these figures, by the weight of the sheet abutment portion 28*a* and others in the sheet presence detecting flag 328 will be denoted as Ma, and a moment acting clockwise in the figures by the weight of the extension portion 28*b* and others will be denoted as Mb. A clockwise moment in the figures acting on the sheet presence detecting flag 328 by the weight of the flag link 232 will be denoted as Mc. A counterclockwise moment in the figures acting on the sheet presence detecting flag 328 in a case when a smallest size sheet S that can be outputted from the image forming apparatus 100 is supported on the discharge tray 302 will be denoted as Ms.

The sheet presence detecting flag 328 and the flag link 232 may be configured such that those moments meet the following inequalities.

$$Ma<Mb+Mc \quad \text{Expression 1}$$

$$Ma+Ms>Mb+Mc \quad \text{Expression 2}$$

$$Ma>Mb \quad \text{Expression 3}$$

The sheet presence detecting flag 328 is held at the positions respectively indicated in the drawings in the conditions illustrated in FIGS. 9A, 9B and 9C by meeting the relationships of these Expressions 1, 2 and 3.

Such arrangement makes it possible to recede the sheet presence detecting flag 328 inside of the discharge tray 302 in the case when the discharge tray 302 is located at a position other than the upper limit position, in addition to similar advantages to those in the first and second embodiments described above. That is, the sheet abutment portion 28*a* of the sheet presence detecting flag 328 will not project above the supporting surface 2*a* of the discharge tray 302 when the user removes sheets S which have been supported over a certain amount on the discharge tray 302. Meanwhile, because the sheet presence detecting flag 328 moves to the standby position by the weight of the flag link 232 when the discharge tray 302 rises to the upper limit position, it becomes possible to detect the sheet S by the sheet presence detecting sensor 221. Therefore, it is possible to reduce a possibility that the user may access and damage the sheet presence detecting flag 328 while making it possible to detect the presence of the sheet in the same manner with the first and second embodiments.

It is noted that an urging member urging the sheet presence detecting flag 328 and the flag link 232 to the predetermined positions may be disposed as long as the similar operation with the sheet presence detecting flag 328 in FIGS. 9A through 9C can be achieved.

Fourth Embodiment

Figure 10:
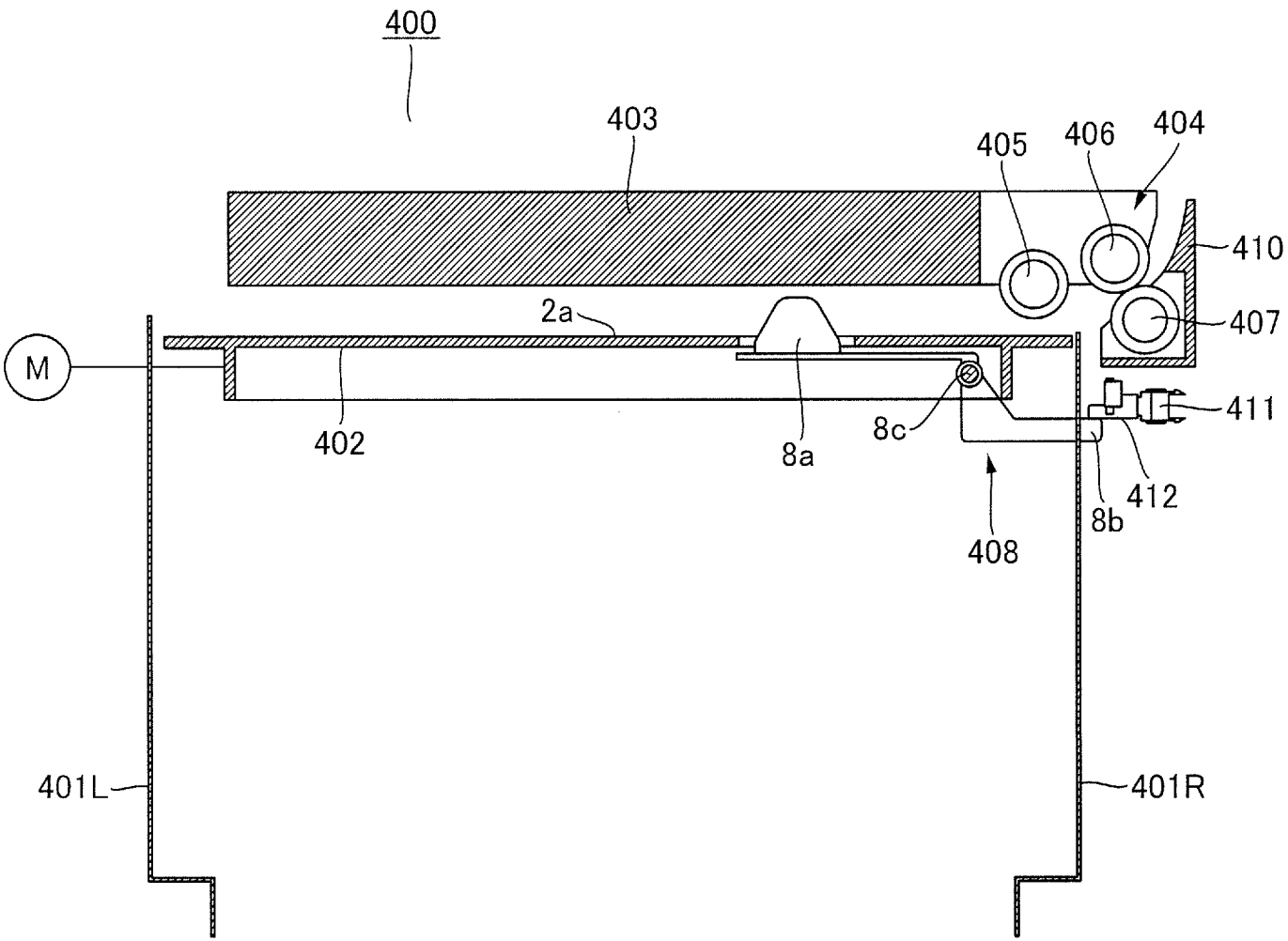
FIG. 10 is a schematic section view illustrating a sheet feeding apparatus of a fourth embodiment.

Next, a sheet supporting unit according to a fourth embodiment will be described with reference to FIG. 10. Differing from the first through third embodiments described above, a sheet feed portion 400 of the present embodiment is a sheet supporting unit composing a sheet feeding apparatus configured to feed the sheet S. The sheet feed portion 400 can be employed as a part of the printer body 100B illustrated in FIG. 1 or as an optional feeder attachable to the printer body 100B.

The sheet feed portion 400 includes a left frame 401L, a right frame 401R, an upper frame 403, a feed tray 402, and a feed unit 404. The left frame 401L, the right frame 401R, and the upper frame 403 define a storage space for storing the sheet S together with a wall surface not illustrated in a front-back direction. The feed tray 402, which is another example of a movable tray, moves up and down in a vertical direction within the storage space by being driven by the lifting motor M. A moving range of the feed tray 402 is defined by upper and lower limit position sensors not illustrated. Still further, the feed tray 402 is configured to be drawn out of the apparatus body.

The feed unit 404, which serves as the feed member configured to feed the sheet S supported on the feed tray 402, includes a pickup roller 405, a feed roller 406 and a retard roller 407. The sheet S delivered out by the pickup roller 405 is conveyed by the feed roller 406 while being separated one by one by the retard roller 407 to which a reverse drive is inputted and is fed toward the image forming portion and others along a conveyance guide 410.

The sheet feed portion 400 includes a mechanism similar to those of the second and third embodiments described above as a detection mechanism configured to detect a presence of the sheet S supported on the feed tray 402. That is, the sheet feed portion 400 includes a sheet presence detecting flag 408 serving as a swing member, a flag link 412 serving as a turning member, and a sheet presence detecting sensor 411 serving as a detecting portion.

The sheet presence detecting flag 408 includes the sheet abutment portion 8*a* abuttable with the sheet S supported on the feed tray 402 and the extension portion 8*b* extending toward the right frame 401R and is swingably supported by the feed tray 402 centering on the swing shaft 8*c*. The extension portion 8*b* extends to an inside of the apparatus body (the same side with the sheet presence detecting sensor 411) through an opening portion such as a slit defined within a wall surface of the right frame 401R.

The flag link 412 includes an abutment portion abuttable with the extension portion 8*b* and a projecting portion detected by the sheet presence detecting sensor 411 and is turnably supported by the apparatus body. In a case when no sheet S is supported on the supporting surface 2*a* of the feed tray 402 in a condition in which the feed tray 402 is located at the upper limit position, the sheet presence detecting sensor 411 is shaded by the projecting portion of the flag link 412. In a case when the sheet S is supported on the feed tray 402 in the condition in which the feed tray 402 is located at the upper limit position, the shade of the sheet presence detecting sensor 411 is released because the extension portion 8*b* of the sheet presence detecting flag 408 pushes up the projecting portion and the flag link 412 turns.

The control portion judges the presence of the sheet S supported on the feed tray 402 through a process of a flow similar to those of the abovementioned embodiments. That is, in a case when the upper limit position sensor is OFF or the sheet presence detecting sensor 411 is OFF, the control portion judges that the sheet is present on the feed tray 402. Still further, in a case when the upper limit position sensor is ON and the sheet presence detecting sensor 411 is ON, the control portion judges that no sheet is present on the feed tray 402.

However, an operation after judging the presence of the sheet S is different from those of the abovementioned embodiments. In a case when the sheet is present on the feed tray 402, the control portion causes the feed unit 404 to feed the sheet S supported on the feed tray 402 based on a command of starting to form an image. Meanwhile, in a case when there is no sheet on the feed tray 402, the control portion stops a feed operation of the feed unit 404 and informs the user to replenish a sheet S by displaying a message on a liquid crystal panel not illustrated.

Such arrangement realizes the configuration of detecting swing positions of the sheet presence detecting flag 408 by the sheet presence detecting sensor 411 located inside of the right frame 401R also in the present embodiment. Then, it is possible to obtain similar advantages to those of the abovementioned embodiments also by the sheet supporting unit configured to feed the sheet S. That is, it is possible to reduce the production cost and to improve the degree of freedom of design because guide configurations for guiding wires connecting the apparatus body surrounding the storage space and the feed tray 402 and arrangement for preventing the user from touching the wires are not necessary.

Other Embodiments

While the configuration in which the plate-like discharge tray 302 or the feed tray 402 have used as the movable tray in the first through fourth embodiments described above, the shape of the movable tray is not limited to the shape of a tray (dish) as long as the sheet S is supported on the sheet supporting surface. Still further, a moving direction of the movable tray is not limited to the vertical direction and the movable tray may move up and down along an inclination of the side wall portion in a case when the side wall portion is inclined with respect to the vertical direction for example. The technology of the present disclosure is also applicable to what the movable tray moves relatively in a mode other than the lift operation with respect to the apparatus body such as a case in which the movable tray opens/closes for example.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-118175, filed on Jun. 14, 2016, which is hereby incorporated by reference wherein in its entirety.

What is claimed is:

1. A sheet discharging apparatus, comprising:

an apparatus body;

a discharge member provided in the apparatus body and configured to discharge a sheet;

a movable tray movable with respect to the apparatus body and including a sheet supporting surface configured to support the sheet discharged by the discharge member;

a movable member provided in the movable tray and configured to move by being pressed by the sheet supported on the sheet supporting surface;

a first detecting portion provided in the apparatus body and configured to detect movement of the movable member in a state where the movable tray is at an upper position in a moving direction of the movable tray, wherein a detection result of the first detecting portion changes depending on a position of the movable tray in the moving direction;

a second detecting portion configured to detect the position of the movable tray in the moving direction; and a control portion configured such that in a case where the second detecting portion detects that the movable tray is at the upper position, the control portion determines whether a sheet is present on the movable tray based on the detection result of the first detecting portion, and in a case where the movement of the movable member is not detected by the first detecting portion, and the second detecting portion detects that the movable tray is not at the upper position, the control portion determines that a sheet is present on the movable tray.

2. The sheet discharging apparatus according to claim 1, wherein the movable member includes an extension portion extending out of the movable tray toward the apparatus body, wherein the apparatus body is provided with an opening portion through which the extension portion extends into the apparatus body, the opening portion being formed such that the extension portion is movable along a moving direction of the movable tray within the apparatus body, and wherein the first detecting portion is configured to detect the extension portion.

3. The sheet discharging apparatus according to claim 2, wherein the apparatus body includes an alignment reference wall configured to abut with an end portion of the sheet supported on the sheet supporting surface and align the sheet, and wherein the opening portion is provided in the alignment reference wall.

4. The sheet discharging apparatus according to claim 3, wherein the movable member further includes a sheet abutment portion abuttable with the sheet supported on the sheet supporting surface, wherein the extension portion extends toward the alignment reference wall, and wherein the sheet abutment portion is movable between a first position where the sheet abutment portion projects above the sheet supporting surface and a second position where a level of the sheet abutment portion is lower than a level of the sheet supporting surface.

5. The sheet discharging apparatus according to claim 4, further comprising a driving source configured to drive and move the movable tray with respect to the apparatus body, wherein the control portion is disposed in the apparatus body and is configured to control the driving source to move the movable tray in response to the detection result by the first detecting portion, wherein the first detecting portion is a photoelectric sensor electrically connected with the control portion and configured to detect movement of the movable member between the first position and the second position.

6. The sheet discharging apparatus according to claim 2, wherein the opening portion defines a slit formed along the moving direction of the movable tray.

7. The sheet discharging apparatus according to claim 1, further comprising a third detecting portion configured to detect that the movable tray is at a lower position within a movable range in a vertical direction, the lower position being below the upper position in the vertical direction.

* * * * *